United States Patent [19]

Morini

[11] Patent Number: 4,978,479

[45] Date of Patent: Dec. 18, 1990

[54] CORRECTED JET FOR AN ENGINE CARBURETOR

[76] Inventor: Marco Morini, Via Ponte Romano 108, I-11027 Saint Vincent, Italy

[21] Appl. No.: 406,571

[22] Filed: Sep. 13, 1989

[30] Foreign Application Priority Data

Sep. 30, 1988 [IT] Italy ..... 67876 A/88

[51] Int. Cl.[5] ..... F02M 7/23

[52] U.S. Cl. ..... 261/121.3

[58] Field of Search ..... 261/121.3

[56] References Cited

U.S. PATENT DOCUMENTS

| | | | |
|---|---|---|---|
| 1,562,651 | 11/1925 | Mock | 261/121.3 |
| 1,613,257 | 1/1927 | Woolson | 261/121.3 |
| 2,043,514 | 6/1936 | Mennesson | 261/121.3 |
| 3,387,831 | 6/1968 | Brown et al. | 261/121.3 |
| 3,940,460 | 2/1976 | Graybill | 261/121.3 |
| 4,080,409 | 3/1978 | Graybill | 261/121.3 |
| 4,229,384 | 10/1980 | Karino et al. | 261/121.3 |
| 4,465,641 | 8/1984 | Morini | 261/41.4 |
| 4,515,734 | 5/1985 | Rock et al. | 261/121.3 |

FOREIGN PATENT DOCUMENTS

| | | | |
|---|---|---|---|
| 534253 | 9/1931 | Fed. Rep. of Germany | 261/121.3 |
| 53-72935 | 6/1978 | Japan | 261/121.3 |

*Primary Examiner*—Tim Miles

*Attorney, Agent, or Firm*—Young & Thompson

[57] ABSTRACT

A jet for the carburetor of a gasoline internal combustion engine, including means for automatically correcting the composition (dosing) of the mixture which is delivered in the different operation conditions of the engine, comprises a delivery spout connected to a first vertical tube which plunges in a constant level fuel bowl and is provided with a fuel nozzle, and a second vertical tube which plunges into the constant level fuel bowl, surrounds the first vertical tube and forms a gap with respect to the same; this second vertical tube is closed at its lower end by a bottom traversed by a calibrated hole, and is provided with through apertures located at a level higher than the constant level of the gasoline in the fuel bowl. Preferably the first vertical tube has an air intake provided with a primary air nozzle and another air intake provided with a secondary air nozzle, and it is internally provided with a dividing wall which delimits a section communicating with the secondary air nozzle and extending downwards within the first vertical tube.

6 Claims, 1 Drawing Sheet

CORRECTED JET FOR AN ENGINE CARBURETOR

BACKGROUND OF THE INVENTION

This invention refers to a jet for the carburetor of a gasoline internal combustion engine, including means for the automatically correcting the composition (dosing) of the mixture which is delivered in the different operation conditions of the engine.

As known, an elementary carburetor, comprising a choke in the form of a venturi tube where the air sucked by the engine flows, a gasoline jet located in the restricted cross section of the choke, a constant level fuel bowl which feeds the gasoline to the jet, and a calibrated nozzle (fuel nozzle) located between the fuel bowl and the jet, supplies to the engine an air and gasoline mixture whose composition is not constant but changes with the increase of the air flow sucked by the engine. Different devices have been proposed in order to automatically correct this change in the composition of the delivered mixture. Among them it is often used a so called air brake device, which includes a sump located between the fuel nozzle and the jet. A blind tube having an apertured wall plunges within the sump and at top it communicates with the ambient air through another calibrated nozzle (air nozzle). Thanks to this device the jet sucks, along with the gasoline which flows through the fuel nozzle, some air which is sucked through the air nozzle and comes out through the apertures in the tube wall. This air opposes some resistance to the gasoline flow within the sump, and this resistance increases when the flow increases, whereby the desired correction may be obtained within certain limits during a constant speed operation. However such device has some drawbacks. It considerably complicates the carburetor structure; its manufacture is somewhat expensive; the setup thereof is difficult and does not allow to obtain a complete correction; and the access to its component parts is difficult even for the simple cleaning. This device has a favorable action during the operation with varying speed too, namely during the acceleration, because the tube which plunges within the sump contains a gasoline reserve, which may be rather easily sucked since it is not hindered by the fuel nozzle but only by the apertures in the tube wall. This action, however, is not practically sufficient, whereby in most cases it is needed that an accelerator pump is provided for.

SUMMARY OF THE INVENTION

The main object of this invention is to propose a jet wherein the automatic correction of the composition of the supplied mixture is effected in a very rational and effective way, although with a very simple structure wherein each component part is easy to be acceded both for the setup and for the cleaning thereof.

This main object is attained, according to the invention, by means of a jet which comprises a delivery spout connected to a first vertical tube which plunges in a constant level fuel bowl and is provided with a fuel nozzle, and a second vertical tube which plunges into the constant level fuel bowl, surrounds the first vertical tube and forms a gap with respect to the same, this second vertical tube being closed at the lower end thereof by a bottom traversed by a calibrated hole, and being provided with through apertures located at a level higher than the constant level of the fuel bowl.

Thanks to these features, the gasoline level which establishes during a constant speed operation within the gap formed between the two vertical tubes decreases when the delivered fuel flow increases. This level determines the head applied to the fuel nozzle, and therefore it ensues an action opposing the tendency to deliver too rich mixture to the engine when the speed thereof increases.

A second object of the invention is to improve a jet as above defined so as to support as much as possible the mixing of gasoline and air and the vaporization of the gasoline.

This second object of the invention is attained in that said first vertical tube has an air intake provided with a secondary air nozzle and it is internally provided with a dividing wall which delimites a section communicating with said secondary air nozzle and extending downwards within said first vertical tube.

Thanks to this feature, some secondary air is sucked along with the gasoline and is guided by said dividing wall to gurgle through the sucked gasoline.

Preferably, moreover, said first vertical tube has at its top end another air intake provided with a primary air nozzle. This nozzle offers a further component which may be controlled in order to setup the dosing.

A third object of the invention is to improve a jet as above defined in order to confer to it such a favorable action during the operation with varying speed, that it becomes unncessary to provide for an accelerator pump.

This third object of the invention is attained in that said dividing wall extends downwards within the first vertical tube for a substantial part of its height.

Thanks to this feature, the section delimited within the first vertical tube and communicating with the secondary air nozzle forms a fuel reserve which may be sucked without any noticeable resistance when the shutter of the choke is opened in order to pass from a low speed operation to a normal speed operation. Then this fuel reserve transitorily enriches the mixture delivered to the engine during the acceleration, thus replacing the action commonly done by an accelerator pump.

BRIEF DESCRIPTION OF THE DRAWING

The above and other features and the advantages of the invention will appear more clearly from the following description of a complete embodiment of the invention, to be taken as a non limiting example and diagrammatically shown in the accompanying drawing, wherein.

DETAILED DESCRIPTION OF A PREFERRED EMBODIMENT

Figure 1:
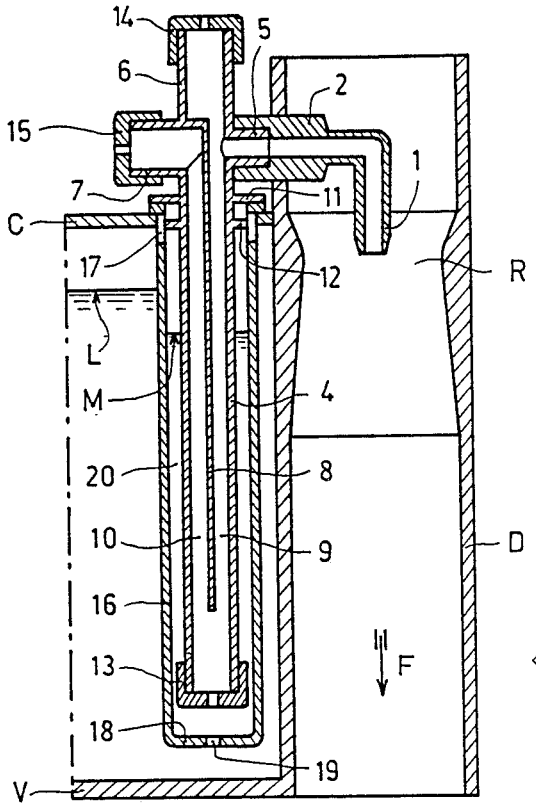
FIG. 1 shows a vertical cross section, on a somewhat enlarged scale, of a jet according to the invention, plunged into a constant level fuel bowl, only partially shown, and opening in the restricted cross section of a venturi tube choke.
Figure 2:
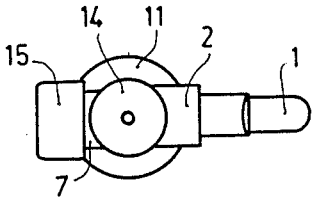
FIG. 2 shows a plan view of the jet shown in FIG. 1.
Figure 3:
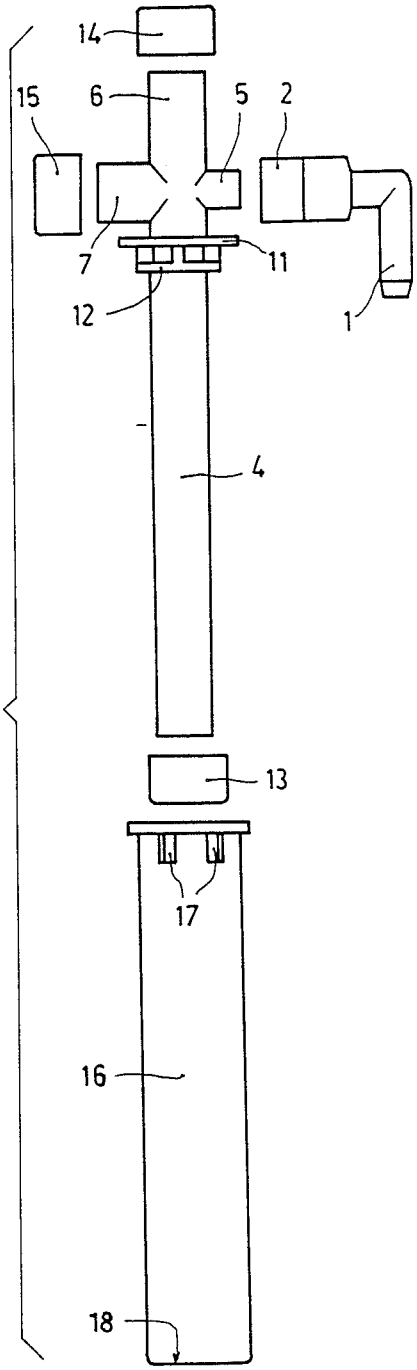
FIG. 3 is an exploded view of the same jet divided into its component parts.

Referring at first to FIG. 1, reference V designates a fuel bowl, having a top cover C, and wherein a level L of gasoline is kept constant by means of devices per se well known, which are not described nor shown here.

Reference D designates a choke which is intended to be connected to the intake manifold of a gasoline internal combustion engine, and wherein the air sucked by the engine flows in the direction of arrow F. The choke D is shaped like a venturi tube and it has a restricted cross section R. Within this restricted cross section R opens the delivery spout 1 of the jet. In the shown embodiment, this spout is curved at 90° and it is connected to a coupling union 2 which passes through a corresponding hole of the wall of choke D for connecting to the further component parts of the jet. However this feature, although useful for the manufacture, is not necessary, and the delivery spout 1 could also be formed integrally with other component parts of the jet.

Outside the choke D, the jet comprises a first vertical tube 4 which traverses the cover C of the fuel bowl V and plunges therein. Tube 4 has a side union 5 to which is connected the coupling union 2 of the delivery spout 1. At its bottom end tube 4 has a calibrated nozzle 13 which forms the fuel nozzle of the jet. In the shown embodiment, the vertical tube 4 extends at the top end by forming a section 6 which opens in the ambient air and carries a calibrated nozzle 14 forming the primary air nozzle. Moreover, in the shown embodiment, tube 4 has a union 7 opposite union 5, which opens in the ambient air and carries a calibrated nozzle 15 forming a secondary air nozzle. In the shown embodiment, the interior of the vertical tube 4 is divided by a dividing wall 8 which extends for a part of the height of tube 4. The dividing wall 8 divides tube 4 into a section 9, communicating with the delivery spout 1 and with the primary air nozzle 14, and a section 10, communicating with the secondary air nozzle 15. The vertical tube 4 finally has a pair of external flanges 11 and 12. As already stated, the component parts 6, 7 and 8 are specific of the shown embodiment, because they are not necessary for attaining the main object of the invention. Therefore it may be foreseen that all of a part of said components are missing in simplified embodiments. In such simplified embodiments, tube 4 should be blind where the missing air nozzle or nozzles are provided for in the shown embodiment.

The jet finally comprises a second vertical tube 16, whose top end is connected to the flanges 11 and 12 and communicates with the ambient of the fuel bowl V, over the gasoline level L, through openings 17. The lower end of tube 16 is closed by a bottom 18 wherein there is a calibrated hole 19. The inner diameter of tube 16 is somewhat larger than the outer diameter of the fuel nozzle 13 mounted onto the bottom end of the vertical tube 4. Between the two vertical tubes 4 and 16 there is a gap 20.

In order to explain the essential operation of the described device it will at first be assumed that the primary air nozzle 14 and the secondary air nozzle 15 are closed, which corresponds to the parts 6, 7 and 8 being missing, whereby tube 4 is blind at its top end. As already stated, this may be foreseen in some simplified embodiments of the invention, which are intended to attain the main object only among the various objects of the invention stated above.

When no flow F of sucked air flows through the choke D, namely when the engine is at rest or it operates at the minimum speed with the choke shutter closed, no suction is applied to the delivery spout 1, and the jet does not deliver any amount of gasoline. In this condition, within the gap 20 between the vertical tubes 4 and 16, which communicates with the fuel bowl V at bottom through the calibrated hole 19 and at top through the openings 17, establishes a gasoline level which registers with the gasoline level L in the fuel bowl V. It is noted that, on the contrary, in FIG. 1 a gasoline level M in gap 20 is shown, which does not register with level L, because FIG. 1 refers to operating conditions different from those now assumed.

When, on the contrary, a flow F of sucked air flows through the choke D, a suction is applied to the delivery spout 1 which is located in the restricted cross section R of the choke. By action of this suction a certain amount of gasoline is sucked from the fuel bowl V through the calibrated hole 19, the fuel nozzle 13 and tube 4, and is sprinkled in the choke D through the delivery spout 1. This gasoline flow undergoes a head loss due to the resistance of the calibrated hole 19, and therefore within gap 20 now establishes a gasoline level M which, as shown by FIG. 1, lies under the gasoline level L in the fuel bowl V. More precisely, level M is the more lower than level L in the fuel bowl V, the greater is the gasoline flow through the calibrated hole 19. Now, the fuel nozzle 13 of the choke determines the amount of delivered gasoline as a function of the underpressure in the restricted cross section R of choke D and as a function of the head to which the fuel nozzle is subjected. Therefore the fuel nozzle is no more subjected, as in the known carburetors, to a constant head which corresponds to the gasoline level L in the fuel bowl V, but to a variable head, which corresponds to the gasoline level M in gap 20, and which decreases when the flow of air sucked by the engine increases. This action is contrary to the tendency to deliver a more rich mixture when the sucked air flow increases, and therefore, as it will be understood, suitable proportions of the various component parts of the jet, and mainly of the fuel nozzle 13 and the calibrated hole 19, allow to obtain for the delivered mixture the changes assumed to be more suitable, as a function of the engine speed.

Moreover, the capacity of gap 20 also exerts a favorable action during any operation with variable speed, either during the acceleration or during the slowing down. In effect, during an acceleration, level M in gap 20 should lower from the higher level corresponding to the initial lower engine speed to the lower level corresponding to the final higher engine speed, and all the amount of gasoline corresponding to this change in level is additionally delivered to the engine during the acceleration. On the contrary, during a slowing down, level M in gap 20 should rise from the lower level corresponding to the initial higher engine speed to the higher level corresponding to the final lower engine speed, and all the amount of gasoline corresponding to this change in level is substracted to the delivery to the engine during the slowing down. This behaviour is favorable in terms both of performance and economy, and the importance thereof can be proportioned by suitably choosing the capacity of gap 20.

Now considering the secondary air nozzle 15, which communicates with section 10 defined by wall 8 within tube 4, it will be remarked that, due to the underpressure which establishes in tube 4, a certain amount of air is sucked through nozzle 15, flows downwards within section 10 of tube 4, and then it flows upwards within section 9 along with the gasoline, by gurgling therein and favoring the gasoline vaporization. In this way, the spout 1 delivers in choke D the gasoline already in part mixed with air and vaporized, to the advantage of the homogeneity of the resulting mixture. Moreover, the presence of the secondary air nozzle 15 offers a further element which may be controlled in order to attain the dosing conditions assumed to be the more suitable. The now described action is attained even with a relatively reduced extension of the dividing wall 8. When the primary air nozzle 14 is present too, further air is sucked through this nozzle and is mixed within the deliver spout 1 to the already formed mixture of air and gasoline. A further element for the dosing regulation is thus offered.

An important action is obtained by the described structure when the dividing wall 8 extends for a substantial height downwards within tube 4. In effect, when the engine operates at a minimum speed, and therefore there is no suction through the choke, both sections 9 and 10 of tube 4 are repleted with gasoline up to the gasoline level L in the fuel bowl V. When, then, the engine is accelerated, and the delivery of gasoline through spout 1 takes place, all the gasoline contained in section 10 is sucked without undergoing any resistance, because it has not to flow through any nozzle, hole or restricted cross section, before the suction of secondary air through nozzle 15 takes place. In this way, an important additional amount of gasoline is positively delivered to the engine during the acceleration thereof, so that there is no need for providing an accelerator pump. The importance of this action may be proportioned to the real need by suitably dimensioning the capacity of the section 10 of tube 4. Moreover, the delivery to the engine of the stated additional amount of gasoline is more effective than the injection of a corresponding amount of gasoline as it is usually done by an accelerator pump, because this latter can only inject the fuel under a low pressure, and therefore it cannot effectively pulverize or vaporize the fuel, which then cannot be burnt in the more effective manner. On the contrary, the additional amount of gasoline delivered by the jet of the invention is sucked through the delivery spout 1 within the restricted cross section of choke D, and therefore in the better conditions of mixing.

As it may be seen, even in the more complete embodiments, as that shown in the drawing, the jet of the invention is compact and of simple manufacture, and access to all its component parts is easy, both for the setup and the cleaning.

Of course different modifications, in addition to those already stated, may be made to the device as described and shown. The definition of vertical tube should be realized in the sense that both the first and the second tube should extend downwards within the constant level fuel bowl, but it is not needed that they are exactly vertical. The fuel nozzle may advantageously be mounted onto the bottom end on the first vertical tube, however it could also be mounted in any other region thereof or of the delivery spout. The bottom of the second vertical tube, provided with a calibrated hole, could be replaced by a proper nozzle. The first vertical tube having a dividing wall represents an embodiment suitable for the manufacture, however it could be replaced in operatively equivalent manner by a tube shaped as a U having a bottom opening for gasoline intake. The features of the invention, which have been described in their application to a jet intended for the normal supply of an engine, may also be applied, all or a part thereof, to a jet intended for delivering to the engine the gasoline supply at the minimum speed or during the start period.

I claim:

1. A jet for the carburetor of a gasoline internal combustion engine, said carburetor including a fuel bowl wherein a constant level of gasoline is maintained and a choke having a restricted cross section, wherein flows the air sucked by the engine, wherein the jet comprises a delivery spout located within the restricted cross section of the choke, a first vertical tube which plunges in the constant level fuel bowl, said first vertical tube having a fuel nozzle, said delivery spout communicating with said first vertical tube, a second vertical tube which plunges into the constant level fuel bowl and surrounds said first vertical tube, said second vertical tube having at the lower end thereof a bottom and a calibrated hole traversing said bottom, and having near its top end through apertures located at a level higher than the constant level of gasoline in the fuel there being a gap between said first and second vertical tubes, said first vertical tube having a secondary air intake, a secondary air nozzle, an internal dividing wall, a first section and a second section delimited by said dividing wall, said first section communicating with said delivery spout and said second section communicating with said secondary air intake.

2. A jet as set forth in claim 1, wherein said first vertical tube has at its top end a primary air intake and a primary air nozzle.

3. A jet as set forth in claim 1, wherein said dividing wall extends downwards within said first vertical tube for a substantial part of the height of said first vertical tube.

4. A jet as set forth in claim 1, which comprises a first body including said first vertical tube, an internal dividing wall, a primary air intake, a secondary air intake and a delivery union, a second body including said second vertical tube, said second body being mounted onto said first body, and calibrated nozzles mounted on said first and second bodies.

5. A jet as set forth in claim 4, wherein said delivery spout is mounted onto said delivery union.

6. A jet as set forth in claim 4, wherein said first body also has a pair of outer flanges, said second body being connected to said flanges.

* * * * *